United States Patent [19]

Frankel et al.

[11] 4,001,923

[45] Jan. 11, 1977

[54] JEWELRY CLASP

[75] Inventors: Charles Frankel, Brooklyn, N.Y.; Max Skobel, Edison, N.J.

[73] Assignee: M S Laboratories, Inc., Iselin, N.J.

[22] Filed: May 22, 1975

[21] Appl. No.: 579,838

[52] U.S. Cl. ..... 24/230 SL; 24/211 K

[51] Int. Cl.[2] ..... A44B 17/00

[58] Field of Search ... 24/230 CF, 230 SL, 230 AN, 24/201 BN, 211 K, 211 L, 211 R, 217 W, 110

[56] References Cited

UNITED STATES PATENTS

| | | | |
|---|---|---|---|
| 346,109 | 7/1886 | Kent | 24/230 SL UX |
| 556,219 | 3/1896 | Stone et al. | 24/110 |
| 1,531,757 | 3/1925 | Rogers | 24/110 |
| 2,013,465 | 9/1935 | Johnson | 24/110 X |
| 2,629,156 | 2/1953 | Kamens et al. | 24/211 K |
| 3,144,692 | 8/1964 | Espino | 24/110 X |
| 3,765,064 | 10/1973 | Hoober et al. | 24/211 R |
| 3,793,858 | 2/1974 | Jones | 24/211 L X |

*Primary Examiner*—Donald A. Griffin
*Attorney, Agent, or Firm*—Friedman, Goodman & Teitelbaum

[57] ABSTRACT

A jewelry clasp is provided with a female member and a complementary male member adapted to cooperate with a releasable locking member disposed within the body of the female member, where the locking member engages the male member to hold the male member within the female member to prevent removal thereof. The locking member includes an integral one-piece construction having a locking portion for engaging the male member, a resilient portion for biassing the locking portion against the male member, and an actuating portion for moving the locking portion relative to the pressure of the resilient portion for releasing the male member to permit retraction of the male member from the female member. A holding member disposed within the female member positions the resilient portion relative to the female member. In a modified embodiment, the female member is provided with two integral one-piece locking members to function as a safety precaution to prevent accidental retraction of the male member from the female member.

9 Claims, 5 Drawing Figures

JEWELRY CLASP

BACKGROUND OF THE INVENTION

The present invention relates to a clasp, and more particularly to a jewelry clasp having an integral one-piece locking member for use in securing necklaces, bracelets, watchbands and the like, where opposite ends of the jewelry are secured to either a male or female member of the clasp which are releasably locked together by the locking member.

Several types of jewelry clasps are currently in use to secure necklaces and the like together, however none is entirely satisfactory. The small size and fragile connection of these clamps render them difficult to manufacture and operate. The durability of these clasps is limited for similar reasons.

One jewelry clasp well known in the art requires the wearer to pull back a sliding lever and then position a loop over a small opening. This clasp is difficult to lock together, and also difficult to manufacture. This clasp is further dependent upon the reliability of an extremely fine coil spring which operates in a curved guide rather than a straight line, where unlocking this clasp involves the same kind of difficult manipulation thereof.

Another type of clasp known in the art compels the wearer to manipulate a sharp pin into a narrow groove and then locate a small pivoting lock. Accordingly, this device is also difficult to manufacture. The use of this clasp is somewhat time consuming, often irritating and may result in improper closure of the clasp and subsequent loss or damage to the jewelry.

A further clasp known in the art provides a female member including a body member and a cap member therefor to position a locking member within the female member. Additionally, this member is formed from two separate portions, one portion being the locking portion and the other portion being the spring portion to bias the locking portion against the male member. The difficulty in manufacturing this type of clasp, particularly when a small and fragile construction is required, drastically increases the cost thereof and thereby renders this clasp impractical for mass production thereof.

SUMMARY OF THE INVENTION

The present invention, as will be described more fully hereinafter, provides a jewelry clasp comprising a female member and a male member adapted to be inserted therein, with releasable locking means for engaging the male member to hold same within the female member. The locking means includes an integral one-piece member having a locking portion for engaging the male member, a resilient portion for biasing the locking portion against the male member, and an actuating portion for moving the locking portion relative to the pressure of the resilient portion for releasing the male member to permit retraction thereof from the female member, where holding means position the resilient portion relative to the female member. In a modified embodiment, the female member includes two integral one-piece locking members as described above to function as safety means to prevent accidental retraction of the male member.

Accordingly, it is an object of the present invention to provide a jewelry clasp which overcomes the disadvantages of the prior art.

Another object of the present invention is to provide a jewelry clasp that incorporates simplified means for positively locking male and female members of the clasp together.

A further object of the present invention is to provide a jewelry clasp as mentioned above, wherein the operation of the locking mechanism may be carried out easily and rapidly.

A still further object of the present invention is to provide a jewelry clasp having simplified construction which may be manufactured easily and economically.

Yet another object of the present invention is to provide a jewelry clasp which is not easily damaged and which is reliable in operation at all times.

An added object of this invention is to provide a jewelry clasp having an integral one-piece locking member including a locking portion, a resilient portion and an actuating portion.

Another added object of this invention is to provide a jewelry clasp as mentioned above having two integral one-piece locking members to provide safety means for the jewelry clasp to prevent accidental retraction of the male member from the female member.

And yet another added object of the present invention is to provide a jewelry clasp as mentioned above that includes a positioning member disposed within the female member for positioning the resilient portion of the locking member relative to the female member while also functioning to guide the male member through the female member.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DESCRIPTION OF THE PREFERRED EMBODIMENT

Figure 1:
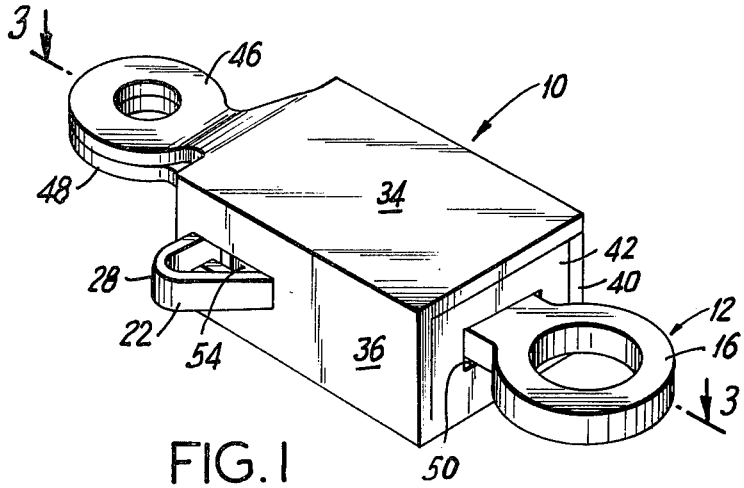
FIG. 1 represents a perspective view of a jewelry clasp pursuant to the present invention, showing the jewelry clasp in a locked position.

Referring to the drawings, FIG. 1 shows a jewelry clasp of the present invention in a locked position. The elements of the jewelry clasp may be fabricated from any suitable material, such as metal or plastic. The jewelry clasp comprises a female member 10 and a cooperating male member 12. The female member is preferably manufactured in a rectangular box-like shape as illustrated in FIGS. 1–4, where the male member 12 is shown having a flat configuration, however these members may be fabricated in any regular or irregular cross sectional configuration, such as cylindrical, square, triangular and the like. It is also possible to fabricate the female member 10 with a different external geometric configuration from that of the male member, for example the female member might have a cylindrical or rod-shaped configuration while being adapted internally to receive a male member having a triangular cross section.

Figure 2:
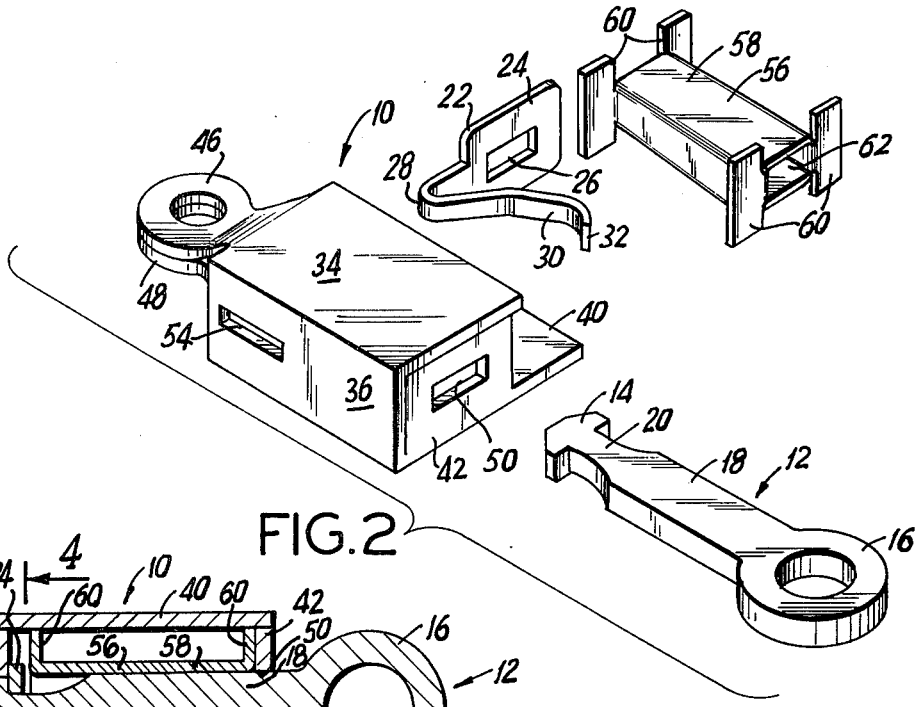
FIG. 2 represents an exploded perspective view of the jewelry clasp shown in FIG. 1.

As shown in FIG. 2, the male member 12 is an elongated rod or plunger having planer surfaces to define a rectangular cross sectional configuration. A chamfered or beveled nose portion 14 is provided in one end of the male member 12, and a ring portion 16 having an opening therein is provided at the opposite end thereof to function as an attachment means for a necklace, watchband and the like. Directly behind the nose portion 14, the intermediate body portion 18 is provided with a reduced neck portion 20. The neck portion 20 is smallest in width immediately adjacent to the nose portion 14, and tapers outwardly to its widest dimension spaced from the nose 14, being formed by a pair of of cut-outs transversely spaced on opposite sides of the neck portion 20. The neck portion 20 is adapted to receive a locking member 22, which will be described hereinafter below.

The locking menber 22 is an integral one-piece construction having a locking portion 24 provided with a centrally disposed aperture 26 therein, a curved actuating portion 28 extending outwardly from the locking portion 24, and a resilient or spring portion 30 extending from the actuating portion 28 in a direction away from the locking portion 24. The tip portion 32 of the resilient portion 30 is turned, the function of which will be described hereinafter below. Although the male member 12 is illustrated as having a chamfered nose 14, any camming shape which would serve to guide the male member 12 into the central aperture 26 of the locking member 22 may be used, where the nose 14 may be bullet-shaped or tapered to a point to be received in a locking portion aperture suitably shaped to permit passage therethrough.

Figure 3:
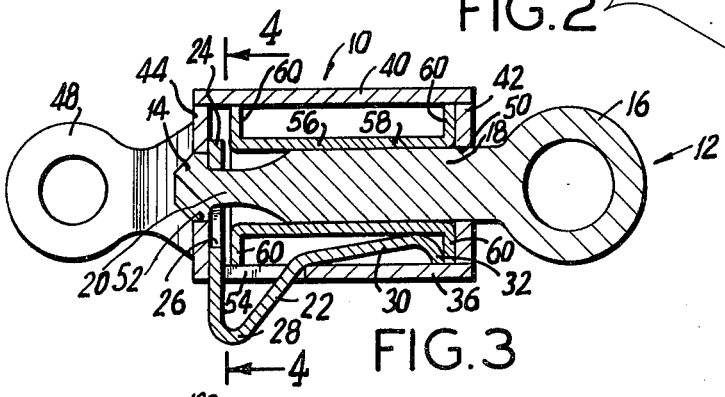
FIG. 3 represents a longitudinal cross section taken on the line 3—3 of FIG. 1.

The female member 10 includes a rectangular box-like construction having large opposing sidewalls 34, 38, small opposing sidewalls 36, 40, and opposing end walls 42, 44. A pair of ring portions 46, 48 having openings therein to function as attachment means for a necklace, watchband and the like, extend outwardly from the sidewalls 34, 38, respectfully and are abutted together as best shown in FIGS. 1 and 2. The end wall 42 opposite the ring portions 46, 48 is provided with an aperture 50 to receive the male member 12 therethrough. Additionally, as best shown in FIG. 3, the other end wall 44 is provided with a similar aperture 52 to receive the nose portion 14 of the male member 12 therethrough. Furthermore, the sidewall 36 is provided with an aperture 54 to receive the actuating portion 28 of the locking member 22 therethrough, as will be discussed hereinafter below.

A bobbin-like positioning member 56, as best shown in FIGS. 2 and 3, is provided with a hollow rectangular shaped body member 58 which is open on both sides to define a cavity or passageway 62 therein. A pair of flanges or leg portions 60 are provided at each open end of the positioning member 56 for proper arrangement of the positioning member 56 within the female member so that the passageway 62 is in alignment with the female member openings 50, 52 as shown in FIG. 3. The flanges 60 are bent outwardly from the body member 58, being integral therewith.

To assemble the female member 10, which is preferably formed from a single sheet material, the sidewall 40 is left in an open position as shown in FIG. 2. The locking member 22 is placed within the female members so that the actuating portion 28 extends outwardly through the opening 54 in the sidewall 36, and the locking portion 24 is positioned against the end wall 44. The tip portion 32 of the resilient member 30 is disposed against the sidewall 36.

The positioning member 56 is now placed into the female member so that the body portion 58 abuts against the resilient member 30 with one of the flanges 60 being held between the tip portion 32 and the end wall 42 as shown in FIG. 3, whereby the flanges 60 disposed closest to the end wall 44 are spaced from the end wall 44 to provide clearance for movement of the locking portion 24. This clearance for the locking portion 24 is maintained because of the pressure of the tip portion 32 against the abovementioned flange 60. The sidewall 40 is now bent over to close the female member 10, thus securing the positioning member 56 therein.

Accordingly, the positioning member 56 retains the spring portion 30 within the female member 10, permitting the spring 30 to rotate or pivot about the tip portion 32 which is secured in place. Thus, the spring portion 32 allows the locking portion 24 to move in a transverse direction relative to the longitudinal length of the female member 10, where the spring portion 30 normally positions the opening 26 in the locking portion 24 out of alignment with the end wall openings 50, 52 and the passageway 62, as will be described in more detail hereinafter below.

Figure 4:
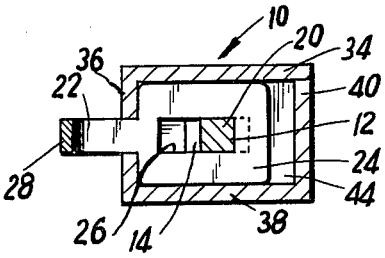
FIG. 4 represents a sectional view taken on the line 4—4 of FIG. 3.

In operation, the male member 12 is inserted into the opening 50 in the end wall 42 of the female member 10, and slidably moved forward towards the locking portion 24, being guided for alignment by the passageway 62 in the body member 58 of the positioning member 56. The chamfered nose portion 14 of the male member 12 passes through the central aperture 26 of the locking portion 24, and acts as a cam against the inner peripheral surface of the opening 26 to temporarily displace the locking portion 24 relative to the pressure of the resilient portion 30 to permit the complete insertion therethrough of the nose portion 14, such that the nose portion 14 extends through the opening 52 in the end wall 44 of the female member 10. The nose portion 14 is spaced from the ring portions 46, 48 as shown in FIG. 3. After the nose portion 14 has passed through the opening 26, the resilient portion 30 biases the locking portion 24 into engagement with the neck portion 20, as shown in FIG. 4, to lock the locking portion 24 behind the nose portion 14 to retain the male member 12 in a lock position within the female member 10.

To unlock the clasp, the actuating portion 28 is pressed inwardly, relative to the pressure of the resilient portion 30, toward the body of the female member 10 to align the locking portion opening 26 with the openings 50, 52 and passageway 62 to thereby disengage the locking portion 24 from behind the nose portion 14. The actuating portion 28 is held in this position until the nose portion 14 of the male member 12 is retracted into the passageway 62, after which the actuating portion 28 is released and the spring 30 returns the locking portion 24 to its nonaligned position. Accordingly, the male member 12 can now be removed from the female member 10. Thus, as shown above, the male member 12 can be repeatedly inserted and removed from the female member 10 in a convenient manner to secure the ends of the jewelry which are connected to the ring portion 16 and 46, 48.

Figure 5:
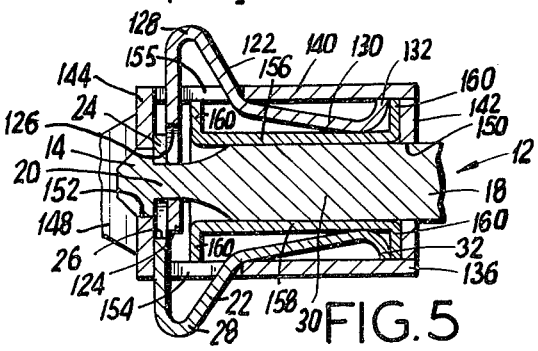
FIG. 5 represents a fragmented longitudinal cross section of a modified embodiment of the present invention, similar to the showing in FIG. 3.

FIG. 5 shows a modified form of the jewelry clasp embodying the features of the present invention, where no modification of the male member 12 is required for this embodiment. The size of the female member 10 is maintained, however provision is made for receiving a second integral one-piece locking member 122 therein. Accordingly, similar to the above-mentioned construction, the female member includes a rectangular box-like construction having large opposing sidewalls (now shown), small opposing sidewalls 136, 140, and opposing end walls 142, 144. A pair of ring portions 148 (the other not shown) having openings therein extend outwardly from the large opposing sidewalls, and are abutted together in a manner mentioned above. The end walls 142, 144 are provided with apertures 150, 152 respectively therein to receive the male member 12 therethrough in a similar manner as mentioned above. Additionally, the sidewalls 136, 140 are provided with apertures or slits 154, 155 respectively to receive the actuating portions 28, 128 of the locking members 22, 122 respectively therethrough, in a similar manner as mentioned above.

Furthermore, the bobbin-like positioning member 156 is made slightly shorter than the positioning member 56 to accommodate both locking portions 24, 124 between the flanges 160 and the end wall 144 as shown in FIG. 5, where the hollow rectangular shape of the body member 158 is maintained to provide a passageway therethrough. It is noted, that the overall length of the locking member 128 is slightly shorter than the overall length of the locking member 28 so that in the assembled position, the locking portion 124 abuts against the locking portion 24, both being movable within the cavity provided between the flanges 160 and the end wall 144.

The modified jewelry clasp functions in a similar manner as that mentioned above, however the nose portion 14 of the male member 12 first passes through the central aperture 126 of the locking portion 124 to temporarily displace the locking portion 124 in one direction against the pressure of the spring portion 130 to permit the nose portion 14 to pass therethrough, and then the nose portion 14 passes through the central aperture 26 of the locking portion 24 to temporarily displace the locking portion 24 in an opposite direction against the pressure of the spring portion 30 to permit the complete insertion therethrough of the nose portion 14, such that the nose portion 14 extends through the opening 152 in the end wall 144 of the female member in a similar manner as mentioned above. After the nose porton 14 has passed through the openings 26, 126, the resilient portions 30, 130 bias the locking portion 24, 124 towards each other into engagement on opposite sides of the neck portion 20, as shown in FIG. 5, to lock the locking portions 24, 124 behind the nose portion 14 to retain the male member 12 in a locked position within the female member. Accordingly, the locking member 122 functions as a safety device to prevent accidental unlocking of the male member 12, whereby both locking members 22, 122 must be disengaged in order to remove the male member 12, as set forth below.

To unlock the clasp, both actuating portions 28, 128 are pressed inwardly towards each other to align the locking portion openings 26, 126 with the openings 150, 152 and the passageway in the positioning member 158 to thereby disengage the locking portions 24, 124 from behind the nose portion 14. The actuating portions 28, 128, which pivot about the tip portions 32, 132 respectively, are held in this inward position until the nose portion 14 of the male member 12 is retracted into the passageway of the positioning member 156, after which the actuating portion 28, 128 are released and the spring portions 30, 130 return the locking portions 24, 124 to their non-aligned position. Accordingly, the male member 12 can now be removed from the female member in a manner similar to that mentioned above, where this insertion and removal of the male member 12 can be repeated as desired.

Numerous alterations of the structure herein disclose will suggest themselves to those skilled in the art. However, it is to be understood that the present diclosure relates to a preferred embodiment of the invention which is for purposes of illustration only and is not to be construed as a limitation of the invention.

What is claimed is:

1. A jewelry clasp comprising a female member having an opening therein;

a male member adapted to be inserted into said female member through said opening;

releasable locking means for engaging said male member to hold said male member to said female member;

said locking means including an integral one-piece locking member having a locking portion for engaging said male member, a resilient portion for biasing said locking portion against said male member, and an actuating portion for moving said locking portion relative to pressure of said resilient portion for releasing said male member to permit retraction of said male member from said female member;

holding means disposed within said female member for positioning said resilient portion relative to said female member;

said holding means including a hollow body element in alignment with said opening in said female member to receive and guide said male member through said female member;

said body element being provided with means to space said body element from internal sidewalls of said female member; and said resilient portion of said locking member being disposed within the space provided between said body element and said internal sidewalls.

2. A jewelry clasp as claimed in claim 1, wherein said locking portion is provided with an aperture to receive said male member, said resilient portion biasing said locking portion to position said aperture out of alignment with said opening in said female member so that walls of said aperture engage said male member in a locked position.

3. A jewelry clasp as claimed in claim 2, wherein said male member is provided with a reduced neck portion for engagement in said aperture.

4. A jewelry clasp as claimed in claim 3, wherein said male member is provided with a nose portion having a cam surface to permit nose portion to pass through said aperture when in the out of alignment position.

5. A jewelry clasp as claimed in claim 1, wherein said locking portion is disposed between said body element and an end wall of said female member which is opposite to said female member opening, said actuating portion connecting said locking portion to said resilient portion, said actuating portion extending through opening means in said female member to permit actuation thereof.

6. A jewelry clasp as claimed in claim 5, wherein said resilient portion includes a turned end portion about which said integral one-piece locking member pivots when said actuating portion is actuated.

7. A jewelry clasp as claimed in claim 1, wherein said female member is a box-like configuration having a hollow rectangular cross-section, and said male member has planar surfaces to provide a solid rectangular cross-section.

8. A jewelry clasp as claimed in claim 1, wherein said locking means includes a second integral one-piece locking member, the two integral one-piece locking members being disposed on opposite sides of said female member as a safety precaution to prevent accidental retraction of said male member from said female member.

9. A jewelry clasp as claimed in claim 8, wherein the actuating portions of said two locking members extend through opening means in said female member to permit actuation thereof, said opening means including a pair of slots spaced apart in opposite sidewalls of said female member, one of said slots being for one of said locking members and the other of said slots being for the other of said locking members, whereby said actuating portions must be moved toward each other in order to remove said male member from said female member.

* * * * *